US007565721B2

(12) United States Patent
Kitano

(10) Patent No.: US 7,565,721 B2
(45) Date of Patent: Jul. 28, 2009

(54) NON-ROTATING SANDWICH BUTTON

(75) Inventor: Katsushi Kitano, Lexington, KY (US)

(73) Assignee: YKK Corporation, Tokyo (JP)

( * ) Notice: Subject to any disclaimer, the term of this patent is extended or adjusted under 35 U.S.C. 154(b) by 134 days.

(21) Appl. No.: 11/393,276

(22) Filed: Mar. 30, 2006

(65) Prior Publication Data

US 2007/0226959 A1 Oct. 4, 2007

(51) Int. Cl.
*A44B 1/28* (2006.01)

(52) U.S. Cl. ..... 24/94; 24/113 MP; 24/114.4; 24/95

(58) Field of Classification Search ..... 24/94, 24/95, 113 R, 113 MP, 578.12, 114.4, 90.1, 24/101 R; 40/315
See application file for complete search history.

(56) References Cited

U.S. PATENT DOCUMENTS

| | | | | |
|---|---|---|---|---|
| 310,273 | A * | 1/1885 | Hamburger | 24/90.1 |
| 2,081,196 | A * | 5/1937 | Emsig | 24/95 |
| 2,332,578 | A * | 10/1943 | Kaynor et al. | 40/315 |
| 3,577,846 | A | 5/1971 | Badger | |
| 4,571,780 | A | 2/1986 | Fukuroi | |
| 4,700,435 | A | 10/1987 | Bush | |
| 4,941,234 | A * | 7/1990 | Watanabe et al. | 24/113 MP |
| 5,575,043 | A * | 11/1996 | Candotti | 24/114.4 |
| 6,618,909 | B1 * | 9/2003 | Yang | 24/113 MP |
| 2007/0214612 | A1 | 9/2007 | Kubota et al. | |

FOREIGN PATENT DOCUMENTS

| | | |
|---|---|---|
| DE | 8710108 | 9/1987 |
| DE | 3725439 | 2/1989 |
| EP | 0 174 606 | 3/1986 |
| JP | UM-48-97104 | 11/1973 |
| JP | 62-161807 | 10/1987 |
| TW | 404184 | 9/2000 |
| TW | M263792 | 5/2005 |

OTHER PUBLICATIONS

EP Search Report for EP Application No. 06024328.4, dated Mar. 19, 2007.

* cited by examiner

*Primary Examiner*—Robert J Sandy
(74) *Attorney, Agent, or Firm*—Alston & Bird LLP

(57) ABSTRACT

The present invention provides a sandwich button including: (1) a collet having a generally cylindrically shaped stem having at a first end a first annular flange extending about a peripheral portion of the first end and extending axially away therefrom; (2) a back member having opposed first and second surfaces, a first attaching member, and a centrally disposed through hole, the first surface of the back member abuts a surface of the first annular flange, an annular lip extends circumferentially about the through hole and axially away from the second surface of the back member, a portion of the lip forms an interference fit with a portion of the stem and defines an interference zone having a non-circular cross-sectional shape, the interference fit prevents relative rotational movement of the back member and the collet; and (3) a shell member having a second attaching member extending axially away from a first surface of the shell member, the second attaching member fixedly engaging the first attaching member to prevent relative rotation of the back member and the shell member.

23 Claims, 4 Drawing Sheets

NON-ROTATING SANDWICH BUTTON

BACKGROUND OF THE INVENTION

The present invention generally pertains to sandwich buttons. More particularly, sandwich buttons assembled from components that are fixedly attached to prevent relative rotational movement of the parts. The present invention further provides fabricating sandwich buttons from existing button stock by attaching an assembly to the button to increase the size of the button. The present invention further pertains to a method for assembling a sandwich button and a device for assembling a sandwich button.

SUMMARY OF THE INVENTION

The present invention provides a sandwich button including: (1) a collet having a generally cylindrically shaped stem having at a first end a first annular flange extending about a peripheral portion of the first end and extending axially away therefrom; (2) a back member having opposed first and second surfaces, a first attaching member, and a centrally disposed through hole, the first surface of the back member abuts a surface of the first annular flange, an annular lip extends circumferentially about the through hole and axially away from the second surface of the back member, a portion of the lip forms an interference fit with a portion of the stem and defines an interference zone having a non-circular cross-sectional shape, the interference fit prevents relative rotational movement of the back member and the collet; and (3) a shell member having a second attaching member extending axially away from a first surface of the shell member, the second attaching member fixedly engaging the first attaching member to prevent relative rotation of the back member and the shell member.

The present invention further provides a sandwich button assembly having: (1) a button having a flange and a generally centrally disposed stem extending from a first surface of the flange; (2) a shell extending across a second surface of the flange opposed to the first surface the shell having a first attaching member; and (3) a back mounted to the stem and having a second attaching member engaging the first attaching member to trap the button between the shell and the back and to fixedly attach the back to the shell, and the back having a portion fixedly attached to the stem to prevent relative rotation of the button and the back. This sandwich button assembly allows for the use of existing stock of buttons to make buttons of larger size, of differing shape and bearing a differing indicia on an indicia bearing surface, from that of the existing button stock.

The present invention further provides a button including: (1) a shell connected to a back member and defining an interior space between the shell and the back member, the back member having a generally circular through hole; (2) an inside button having a flange positioned within the interior space and a stem having a generally circular cross-sectional shape, the stem extending from the flange through the bottom shell through hole; (3) at least one selected potion of the back member and the stem having abutting non-circular shapes such that relative rotation between the back member and the stem is prevented.

The present invention further provides a method for assembling a sandwich button including the steps of: (1) providing a collet having a flange and a stem; (2) providing a shell member having a first attaching member; (3) providing a back member having a second attaching member, a generally circular shaped through hole, a first surface and a flange extending axially away from the first surface and extending circumferentially about the through hole; (4) positioning the stem within the through hole; (5) applying pressure to a portion of the flange in an axially inward direction to form an interference fit between the flange and the stem to prevent relative rotation of the back and the collet; and (6) attaching the first attaching member to the second attaching member to form an interference fit to prevent relative rotation of the shell and the back.

DETAILED DESCRIPTION OF THE INVENTION

Figure 1:
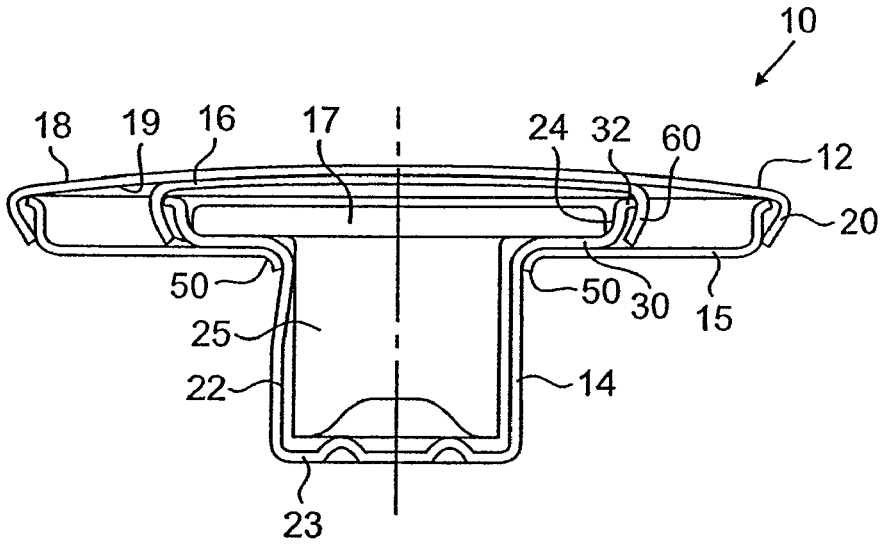
FIG. 1 is a side elevation view in cross-section of a closed top sandwich button.
Figure 2:
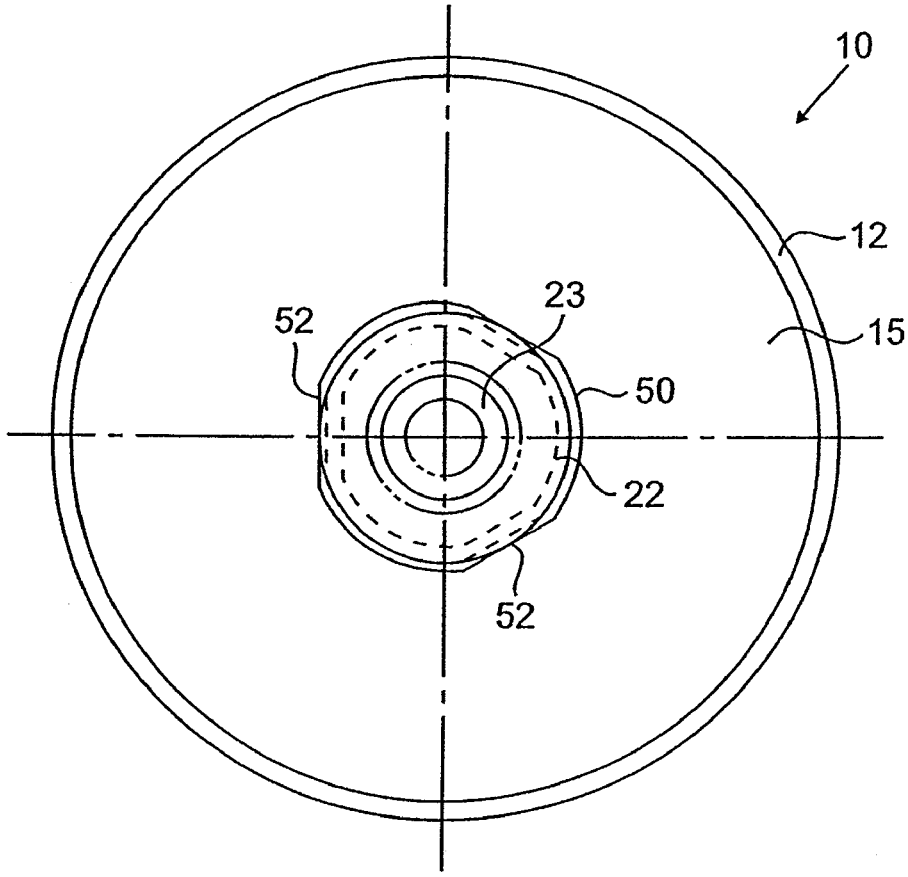
FIG. 2 is a bottom view of the sandwich button of FIG. 1.

FIGS. 1 and 2 show a sandwich button 10 having a shell member 12, a collet 14, a back member 15, an optional cap 16, and an optional insert member 17. This is known as a closed top sandwich button. The shell member 12 has a generally circular shape, opposed first and second surfaces 18, 19 and a flange or lip 20 extending about a peripheral portion of the shell member 12 and axially away from the second surface 19 and serves as a first attaching member. The first surface 18 can be an indicia bearing surface having a logo or other design, words or symbol printed, embossed, debossed or otherwise placed thereon. The first surface 18 can have an uninterrupted surface having a smooth surface profile or a textured profile such as a matte finish. The first surface 18 can also be interrupted having portions removed to define a hole or holes through the thickness of the shell. The holes have any one of numerous shapes such as round, polygonal, oval, irregular, or in the shape of a logo, a word or a symbol. The shell member 12 can be fabricated from metal, plastic, fabric, paperboard, composite, cork or other suitable material. In a preferred form of the invention the shell member 12 will be fabricated from a metal.

Figure 5:
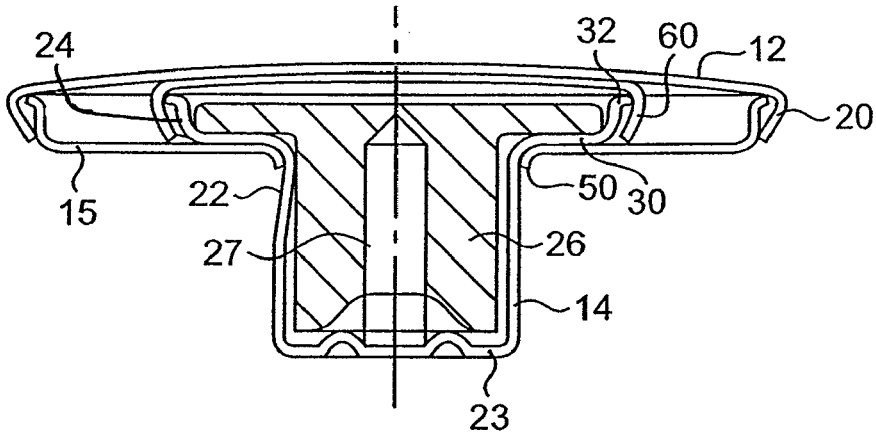
FIG. 5 is a side elevation view of a closed top sandwich button with an insert material.

The collet 14 has a generally cylindrical shaped stem 22 with a bottom 23 closing one end of the stem and a disk shaped flange 24 at an opposite end extending radially outward from the stem. The stem 22 defines a chamber 25 that can be empty or filled with a fill material 26 such as a metal or plastic. In one preferred form of the invention shown in FIG. 5, the fill material 26 is a polymeric material, more preferably a polyamide and most preferably nylon. The fill material can also have a portion removed to define a channel 27 to receive an attaching member such as a rivet to attach the button 10 to a fabric or other substrate.

The disk shaped flange 24 has a radially extending portion 30 and a portion 32 at an outer peripheral edge extending axially upward away from the direction of the stem to define an annular lip or flange. The annular lip 32 serves as an attaching member for connecting the collet to the cap in closed top sandwich buttons.

Figure 6A:
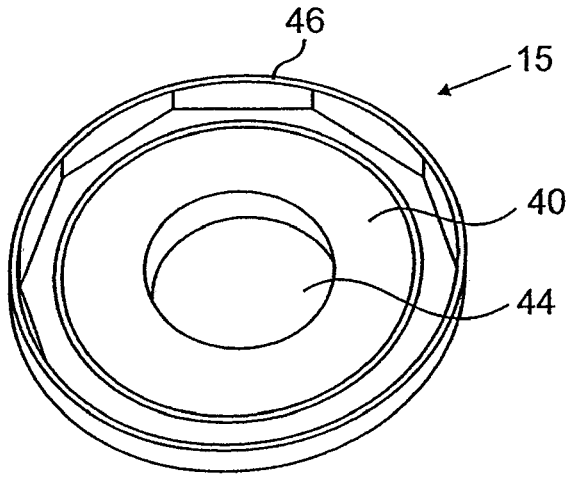
FIGS. 6*a,b* respectively are a top and bottom view of a back member.
Figure 6B:
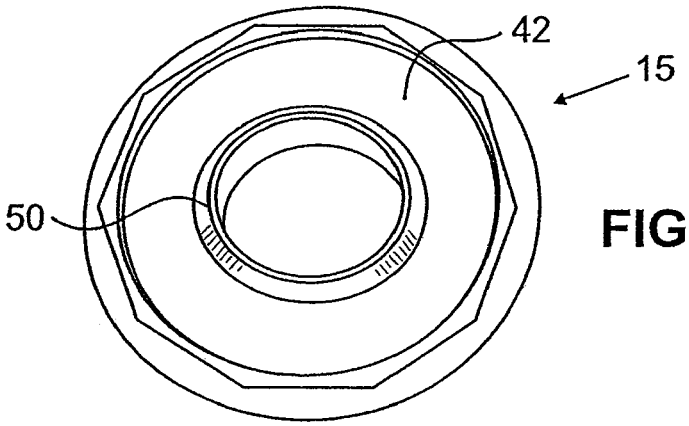
Figure 7:
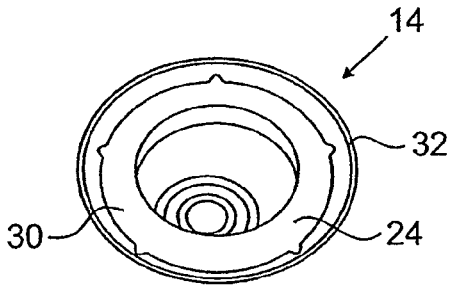
FIG. 7 is a top view of a collet.
Figure 8:
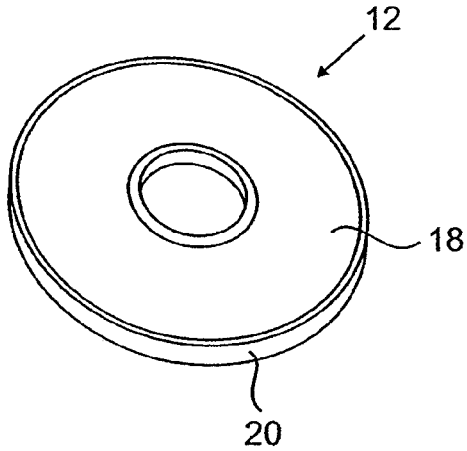
FIG. 8 is a top view of a shell member.

The back member 15 (see also FIGS. 6*a, b*) is generally saucer or disk shaped having opposed first and second surfaces 40, 42, and a centrally disposed through hole 44. A first annular lip 46 extends from an outer peripheral edge of the back member 15 and axially away from the first surface 40. A second annular lip or flange 50 extends circumferentially about the through hole 44 and axially away from the second surface of the back member (in a direction opposite the first annular lip). A portion of the second annular lip 50 extends axially along a portion of the stem and forms an interference fit therewith to define an interference zone 52. As shown in FIG. 2, the interference zone 52 has a non-circular cross-sectional shape and prevents relative rotational movement of the back member 15 and the collet 14. The interference zone shown in FIG. 2 is generally triangular shaped; however, the interference zone could have a polygonal, oval, or irregular shape.

The cap 16 is essentially a smaller version of the shell member described above. It is contemplated that in a closed top sandwich button the cap 16 could be of a different structure or material than the shell. That is, the cap 16 could be made of a polymeric material while the shell member 12 is made from metal. The shell member could have an uninterrupted surface and the cap could have an interrupted surface. The cap 16 has an annular flange 60 that is fixedly attached to the annular lip 32 of the collet 14 to prevent relative rotational movement of the cap 16 and the collet 14.

Figure 3:
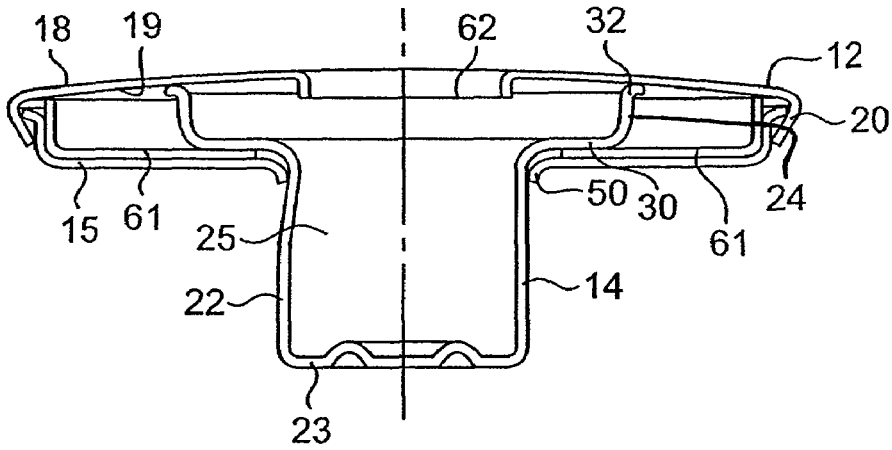
FIG. 3 is a side elevation view in cross section of an open top sandwich button.
Figure 4:
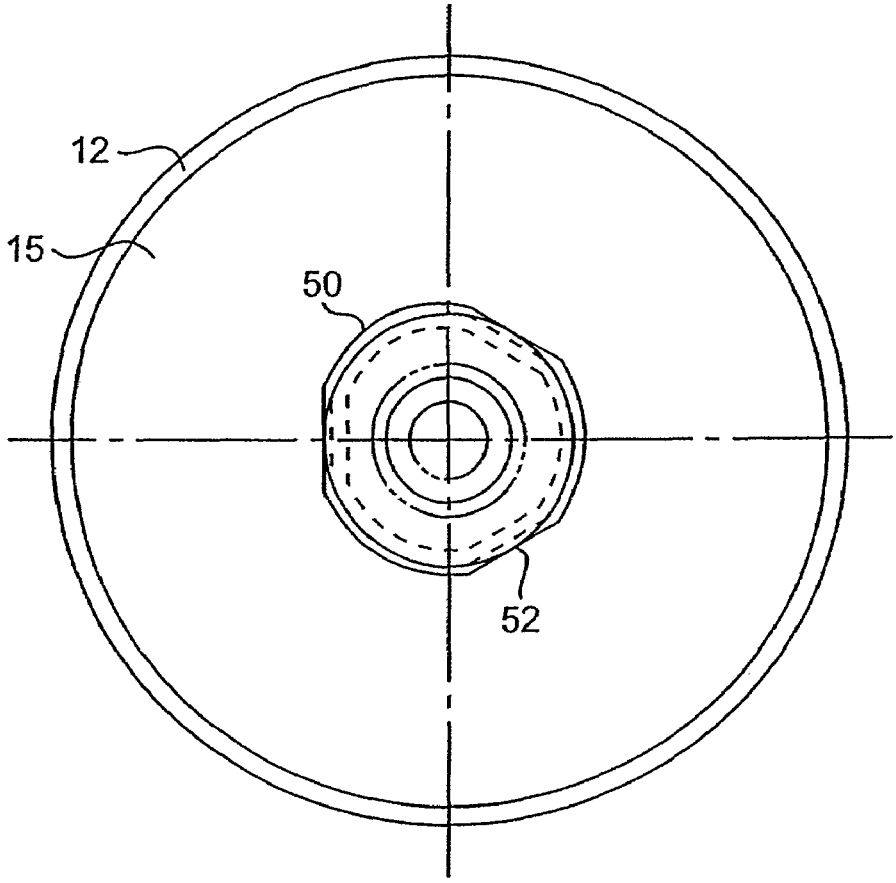
FIG. 4 is a side elevation view in cross-section of a sandwich button having a rivet receiving channel.

FIGS. 3 and 4 show an open top sandwich button that is the same in all respects as the sandwich button shown in FIGS. 1 and 2 except it has no cap 16. Further, the shell member 12 is shown with a centrally disposed through hole 62 but this is an optional feature as it could be just as described above with or without interruptions, etc. Additionally, FIG. 3 shows an optional second back member or insert 61 for support of the shell 12.

Figure 10:
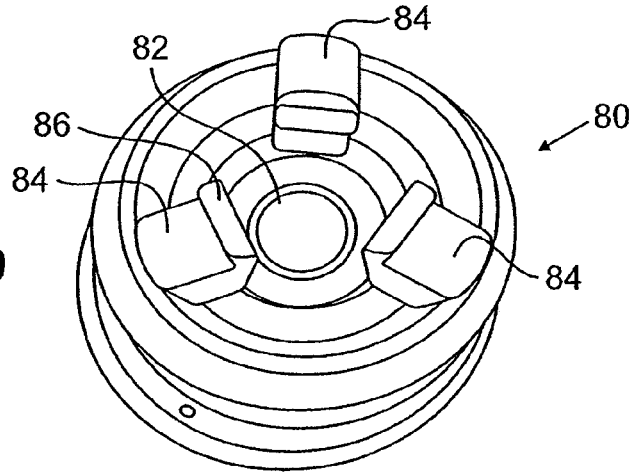
FIG. 10 is a crimping tool used to assemble the sandwich buttons of the present invention.

The open and closed top sandwich buttons are assembled using a crimping tool 80 shown in FIG. 10. The tool has a centrally disposed cylindrical chamber 82, three fingers 84 circumferentially spaced about the chamber 82, and each finger 84 having an upwardly extending flange 86 at its distal end. To crimp a collet to the back member 15, a collet 14 or an entire smaller closed top button consisting of the collet 14, the insert, 17 or 26, and the cap 16, are placed on a flat surface with the stem 22 of the collet 14 facing up. For a closed top button, the back member 15 is placed over the stem 22 of the collet 14 with the annular lip 50 facing up and the first annular lip 46 facing down. It is contemplated that existing button stock could be fitted with a back member and a shell and assembled as described to form a sandwich button having an increased diameter or an increased area of the indicia bearing surface. Essentially, the existing button is trapped between the shell member and the back member and fixedly attached together to prevent relative rotation of all components of the closed top sandwich button assembly.

Figure 9:
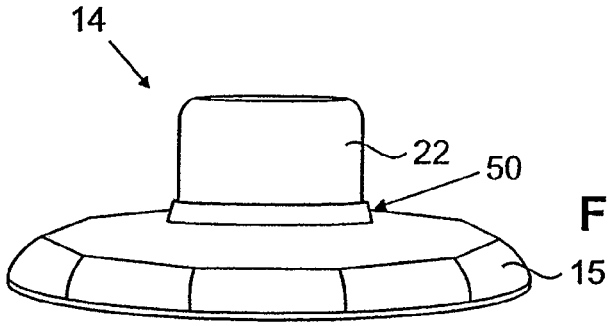
FIG. 9 is a side view of a back member mounted on a collet.

For open top sandwich buttons a back member 50 and support member 61 are mounted to stem 22 of a collet 14 as shown in FIG. 9 with the second annular lip 50 of the back member 15 facing up and the first annular lip 46 facing down.

In both the open and closed top assemblies, the crimping tool 80 is placed over the stem 22 of the collet 14 so that the stem of the collet extends up into the chamber 82 of the crimping tool 80. The crimping tool is brought down causing the extended flanges 86 to press upon the back member 15. Further activation of the crimping tool 80 causes the fingers 84 to move radially inward to apply pressure to the interference zone 52 to deform the assembly of the shank portion 22 of the collet 14 and the second annular lip 50 of the back member 15 from a round cross-sectional shape to a non-round cross-sectional shape. This non-round cross-sectional shape locks the back member 15 to the stem 22 of the collet 14 making it virtually impossible for the back member 15 to rotate relative to the collet 14. A secondary conventional crimping operation secures the flange 20 of the shell member 12 into cooperative engagement about the flange 46 of the back member 15 to fixedly attach the shell member 12 to the back member 15 in both the open and closed top configuration. Conventional locking lugs are embossed into the flange 46 of the back member 15 to secure the shell member 12 to the back member 15 without rotation.

I claim:

1. A sandwich button comprising:

a collet having a stem having a first end and a first annular flange extending about a peripheral portion of the first end and extending axially away therefrom, the stem having a generally cylindrical shape extending the length of the stem;

a back member having opposed first and second surfaces, a first attaching member, and a centrally disposed through hole, the first surface of the back member abuts a surface of the first annular flange, an annular lip extends circumferentially about the through hole and axially away from the second surface of the back member, a portion of the lip and a portion of the stem form an interference fit and define an interference zone having a non-circular cross-sectional shape, the interference zone extending from the lip along the length of the stem, the interference fit prevents relative rotational movement of the back member and the collet; and a shell member having a second attaching member extending axially away from a first surface of the shell member, the second attaching member directly contacting and engaging the first attaching member to prevent relative rotation of the back member and the shell member.

2. The button of claim 1 wherein the back member has a generally disk shape and the first attaching member comprises a second annular flange extending along a peripheral portion of the back member and axially away from the first surface of the back member.

3. The button of claim 2 wherein the shell member is generally circular in shape and the second attaching member is attached about the first attaching member.

4. The button of claim 3 wherein the shell member has an uninterrupted outer surface facing away from the back member.

5. The button of claim 3 wherein the shell member has a portion removed from an outer surface to define a hole having a shape selected from the group consisting of circular, polygonal and oval.

6. A sandwich button assembly comprising:

a button having a flange and a generally centrally disposed stem extending from a first surface of the flange, the stem having a generally cylindrical shape extending the length of the stem;

a shell extending across a second surface of the flange opposed to the first surface of the flange and having a first attaching member; and a back mounted to the stem and having a second attaching member directly contacting and engaging the first attaching member to trap the button between the shell and the back and to fixedly attach the back to the shell, and the back having a portion fixedly attached to the stem to prevent relative rotation of the button and the back.

7. The sandwich button assembly of claim 6 wherein the flange is generally circular in shape and has a first diameter.

8. The sandwich button assembly of claim 7 wherein the stem is concentrically disposed on the flange and has a second diameter.

9. The sandwich button assembly of claim 7 wherein the shell is generally circular in shape and has a third diameter larger than the first diameter.

10. The sandwich button assembly of claim 9 wherein the first attaching member comprises a first annular flange extending along an outer peripheral portion of the shell and engages to second attaching member to prevent relative rotation of the shell and the back.

11. The sandwich button assembly of claim 10 wherein the back is generally saucer shaped in cross sectional dimension.

12. The sandwich button assembly of claim 11 wherein the second attaching member comprises a second annular flange positioned along an outer peripheral portion of the back and extends axially away from a first surface of the back.

13. The sandwich button assembly of claim 12 further comprising a third annular flange extending circumferentially about a through hole and extending axially away from a second surface of the back, the second surface being opposed to the first surface.

14. The sandwich button assembly of claim 13 wherein the through hole is generally centrally disposed on the back and has a fourth diameter larger than the second diameter.

15. The sandwich button assembly of claim 14 wherein the third annular flange cooperatively engages a portion of the stem to prevent rotation of the back with respect to the stem and to define an interference zone, the interference zone extending from the third annular flange along the length of the stem.

16. The sandwich button assembly of claim 15 wherein the interference zone has a non-circular cross-sectional shape.

17. The sandwich button assembly of claim 15 wherein the interference zone has a cross-sectional shape selected from the group consisting of polygonal and oval.

18. The sandwich button assembly of claim 6 wherein the stem has a member for attaching the stem to a fabric.

19. The sandwich button assembly of claim 18 wherein the stem has an outer wall defining a chamber and wherein the chamber has a portion filled with an insert material.

20. The sandwich button assembly of claim 19 wherein the insert material is selected from the group consisting of paper, polymer, metal, composite and cork.

21. The sandwich button assembly of claim 6 wherein the shell has a continuous outer surface.

22. The sandwich button assembly of claim 6 wherein the shell has a generally centrally disposed through hole.

23. A button, comprising:

a shell directly connected to a back member and defining an interior space between the shell and the back member, the back member having a generally circular through hole;

an inside button having a flange positioned within the interior space and a stem having a generally cylindrical shape along the length of the stem, the stem extending from the flange through the generally circular through hole;

at least one selected portion of each of the back member and the stem having abutting non-circular shapes such that relative rotation between the back member and the stem is prevented, each of the at least one selected portions extending from the back member along the length of the stem.

* * * * *